US009657514B1

(12) United States Patent
Whittemore

(10) Patent No.: US 9,657,514 B1
(45) Date of Patent: May 23, 2017

(54) MODULAR DUST PANELS FOR DUST BARRIER INSTALLATION AND METHOD OF INSTALLING THE SAME

(71) Applicant: Zipwall LLC, Arlington, MA (US)

(72) Inventor: Jeffrey P. Whittemore, Arlington, MA (US)

(73) Assignee: Zipwall, LLC., Arlington, MA (US)

( * ) Notice: Subject to any disclaimer, the term of this patent is extended or adjusted under 35 U.S.C. 154(b) by 0 days.

(21) Appl. No.: 14/517,062

(22) Filed: Oct. 17, 2014

Related U.S. Application Data

(60) Provisional application No. 61/892,045, filed on Oct. 17, 2013.

(51) Int. Cl.
*E04G 21/24* (2006.01)
*E06B 9/24* (2006.01)

(52) U.S. Cl.
CPC ..... *E06B 9/24* (2013.01); *E04G 21/243* (2013.01)

(58) Field of Classification Search
CPC ..... E04G 21/243
USPC ..... 160/368.1, DIG. 18; 24/436
See application file for complete search history.

(56) References Cited

U.S. PATENT DOCUMENTS 1,925,815 A 9/1933 McL Nicolson
3,323,530 A 6/1967 Smith
3,699,986 A 10/1972 Kirkham
3,856,072 A 12/1974 Sund
3,872,551 A * 3/1975 Moertel ..... A44B 19/382 24/386
3,874,396 A 4/1975 Kirkham
4,137,683 A 2/1979 Pfeiffer
4,373,570 A 2/1983 Nussdorf et al.
4,438,614 A 3/1984 Raith et al.
4,493,174 A 1/1985 Arens
4,631,765 A 12/1986 Casey
4,682,448 A * 7/1987 Healey ..... E04G 23/00 135/117
4,848,386 A 7/1989 Cooper
4,858,561 A 8/1989 Springer
5,031,516 A 7/1991 Jacobson
5,067,207 A 11/1991 Semons
5,311,648 A 5/1994 Semons
5,345,989 A 9/1994 Brophy
5,427,169 A 6/1995 Saulters
5,592,691 A * 1/1997 Ronald ..... A41D 15/00 2/243.1
5,628,338 A 5/1997 Stumbo
(Continued)

FOREIGN PATENT DOCUMENTS

DE 2510996 9/1976
GB 2412137 9/2005

*Primary Examiner* — David Purol
(74) *Attorney, Agent, or Firm* — Onello & Mello, LLP

(57) ABSTRACT

A dust barrier system includes first and second barrier panels. Each of the first and second barrier panels includes a sheet of material including nylon, first zipper teeth extending from a first side of the sheet of material, second zipper teeth extending from a second side of the sheet of material, and a zipper pull coupled to only one of the first zipper teeth and the second zipper teeth and configured to slide along the one of the first zipper teeth and the second zipper teeth. The first zipper teeth of the first barrier panel mate with the second zipper teeth of the second barrier panel, and the first and second barrier panels are combined to form a barrier.

20 Claims, 19 Drawing Sheets

(56) References Cited

U.S. PATENT DOCUMENTS

| | | | | |
|---|---|---|---|---|
| 5,769,106 | A | 6/1998 | Achuff | |
| 5,819,474 | A | 10/1998 | Strom | |
| 5,924,469 | A | 7/1999 | Whittemore | |
| 5,937,586 | A | 8/1999 | Scherba | |
| 6,298,615 | B1 | 10/2001 | Richardson | |
| 6,540,085 | B1 | 4/2003 | Davies | |
| 6,588,827 | B2 | 7/2003 | Heiland | |
| 6,701,948 | B2 | 3/2004 | Jopp et al. | |
| 6,739,801 | B2 | 5/2004 | Dreyer | |
| 6,742,533 | B2 | 6/2004 | Olson | |
| 6,772,458 | B2 | 8/2004 | Ellen et al. | |
| 6,892,743 | B2 | 5/2005 | Armstrong et al. | |
| 7,100,626 | B2 | 9/2005 | Livacich | |
| 7,121,290 | B2 | 10/2006 | Eastman, II | |
| 7,127,753 | B1 | 10/2006 | Ramaley | |
| 7,134,444 | B2 | 11/2006 | Mintie et al. | |
| 7,188,636 | B1 * | 3/2007 | Kanne | B08B 15/02 135/142 |
| 7,191,555 | B2 | 3/2007 | Hughes | |
| 2002/0005512 | A1 | 1/2002 | Trill | |
| 2004/0209018 | A1 | 10/2004 | Lookholder | |
| 2006/0059806 | A1 | 3/2006 | Gosling et al. | |
| 2006/0254158 | A1 | 11/2006 | Saller et al. | |
| 2006/0283562 | A1 | 12/2006 | Hickey | |
| 2007/0039247 | A1 | 2/2007 | Greenfeld et al. | |
| 2007/0094947 | A1 | 5/2007 | Greenfeld et al. | |
| 2011/0192522 | A1 * | 8/2011 | Whittemore | E06B 3/80 156/66 |

* cited by examiner

MODULAR DUST PANELS FOR DUST BARRIER INSTALLATION AND METHOD OF INSTALLING THE SAME

RELATED APPLICATIONS

This application claims the benefit of U.S. Provisional Patent Application Ser. No. 61/892,045, filed Oct. 17, 2013, the content of which is incorporated by reference herein, in its entirety.

BACKGROUND

Partition mounting systems are employed to isolate portions of a building or room, by serving as a barrier to dust, noise, light, odors, and the like. In construction zones, partition mounting systems are useful for protecting a clean area from a work area, for example, protecting an area where furniture and rugs are temporarily stored from an area where wood floors are being refinished.

Workers at construction sites often use rudimentary techniques for constructing and installing partitions. Some simply nail, screw, or staple a curtain or partition material to the floor, ceiling, and abutting walls, resulting in damage to their surfaces. Others tape, or otherwise adhere, a curtain or plastic sheet to the walls and ceilings. The tape usually fails to stick, but if it does stick, as the tape is removed, paint can pull of with the tape, or adhesive is left behind.

U.S. Pat. No. 5,924,469 and U.S. Pat. No. 7,658,219, the contents of each being incorporated herein by reference in their entirety, disclose various "clean" partition mount systems that are designed to be installed and removed without damaging or otherwise marking the ceiling, floor or walls of a construction zone. In certain applications however, a sag, or gap, may be present in the curtain along a mounting pole next to a wall, ceiling, door frame, or other abutting surface, compromising the effectiveness of the installation.

U.S. Pat. No. 7,073,758 and U.S. Pat. No. 7,533,712, the contents of each being incorporated herein by reference in their entirety, disclose various partition mounting systems. These systems offer the advantage of reducing or eliminating a sag or gap in the curtain along the mounting pole next to a wall, ceiling, door frame, or other abutting surface, thus increasing the effectiveness of the partition mounting system installation.

SUMMARY

In an aspect, a dust barrier system comprises: first and second barrier panels, wherein each of the first and second barrier panels comprises: a sheet of material comprising nylon; first zipper teeth extending from a first side of the sheet of material; second zipper teeth extending from a second side of the sheet of material; and a zipper slider coupled to only one of the first zipper teeth and the second zipper teeth and configured to slide along the one of the first zipper teeth and the second zipper teeth, wherein the first zipper teeth of the first barrier panel mate with the second zipper teeth of the second barrier panel, and wherein the first and second barrier panels are combined to form a barrier.

In an embodiment, the dust barrier system further comprises first and second spring-loaded poles, each of the first and second spring-loaded poles having a head and a foot.

In an embodiment, the first and second barrier panels are positioned between the head and a first surface and between the foot and a second surface.

In an embodiment, the sheet of material comprises nylon taffeta.

In an embodiment, the sheet of material is flame retardant.

In an embodiment, the first and second zipper teeth extend from outermost edges of the first and second sides of the sheet of material.

In an embodiment, the first and second barrier panels are reusable.

In an embodiment, the sheet of material is opaque.

In an embodiment, the dust barrier system further comprises a doorway panel combined with at least one of the first and second barrier panels, wherein the doorway panel has a width less than the first and second barrier panels and comprises: a second sheet of material comprising nylon; third zipper teeth extending from a first side of the second sheet of material; fourth zipper teeth extending from a second side of the second sheet of material, and a second slider having a zipper pull coupled to only one of the third zipper teeth and the fourth zipper teeth and configured to slide along the one of the third zipper teeth and the fourth zipper teeth, wherein the one of the third zipper teeth and the fourth zipper teeth mate with the other of the first zipper teeth and the second zipper teeth of the first and second barrier panels, and wherein the other of the third zipper teeth the fourth zipper teeth mate with the one of the first zipper teeth and the second zipper teeth of the first and second barrier panels.

In an aspect, a method of installing a dust barrier system comprises: combining first and second barrier panels, wherein each of the first and second barrier panels comprises: a sheet of material comprising nylon; first zipper teeth extending from a first side of the sheet of material; second zipper teeth extending from a second side of the sheet of material; and a slider coupled to only one of the first zipper teeth and the second zipper teeth and configured to slide along the one of the first zipper teeth and the second zipper teeth, wherein combining first and second barrier panels comprises mating the first zipper teeth of the first barrier panel with the second zipper teeth of the second barrier panel using the zipper pull, inserting the first barrier panel between a clip and a head of a first spring-loaded pole, positioning a foot of the first spring-loaded pole over the first barrier panel and positioning the first spring-loaded pole between a first surface and a second surface; and inserting the second barrier panel between a clip and a head of second spring-loaded pole, positioning a foot of the second spring-loaded pole over the first barrier panel and positioning the second spring-loaded pole between the first surface and the second surface.

In an embodiment, the sheet of material comprises nylon taffeta.

In an embodiment, the sheet of material is flame retardant.

In an embodiment, the first and second zipper teeth extend from outermost edges of the sheet of material.

In an embodiment, the first and second barrier panels are reusable.

In an embodiment, the sheet of material is opaque.

In an embodiment, the dust barrier system further comprises a doorway panel with at least one of the first and second barrier panels, wherein the doorway panels has a width less than the first and second barrier panels and comprises: a second sheet of material comprising nylon; third zipper teeth extending from a first side of the second sheet of material; fourth zipper teeth extending from a second side of the second sheet of material, and a second slider having a zipper pull coupled to only one of the third zipper teeth and the fourth zipper teeth and configured to slide along the one of the third zipper teeth and the fourth zipper teeth, wherein the doorway panel is combined with the at least one of the first and second barrier panels by mating one of the third zipper teeth and the fourth zipper teeth with the other of the first zipper teeth and the second zipper teeth of the first and second barrier panels, and by mating the other of the third zipper teeth the fourth zipper teeth with the one of the first zipper teeth and the second zipper teeth of the first and second barrier panels.

In an aspect, a dust barrier system comprises a first barrier panel comprising: a sheet of material, a first zipper half at a first vertical edge of the sheet of material; a second zipper half at a second vertical edge of the sheet of material, the second vertical edge opposite the first vertical edge, and a zipper slider slidably coupled to the second zipper half adapted to engage a mating first zipper half of a neighboring barrier panel; a second barrier panel comprising: a sheet of material, a first zipper half at a first vertical edge of the sheet of material; a second zipper half at a second vertical edge of the sheet of material, the second vertical edge opposite the first vertical edge, and a zipper slider slidably coupled to the second zipper half adapted to engage a mating first zipper half of a neighboring barrier panel; wherein the sheets of material of the first barrier panel and second barrier panel are devoid of zipper components on the sheet of material between the first zipper half and the second zipper half.

In an embodiment, dust barrier system of claim 17 the first barrier panel has a first width between the first zipper half and the second zipper half of the first panel, the second barrier panel has a second width between the first zipper half and the second zipper half of the second panel, and further comprising: a third barrier panel comprising: a sheet of material, a first zipper half at a first vertical edge of the sheet of material; a second zipper half at a second vertical edge of the sheet of material, the second vertical edge opposite the first vertical edge, and a zipper slider slidably coupled to the second zipper half adapted to engage a mating first zipper half of a neighboring barrier panel; wherein the third barrier panel has a third width between the first zipper half and the second zipper half of the third panel, wherein the third width is less than the first width and wherein the third width is less than the second width.

In an embodiment, the third width of the third barrier panel is sized to operate as a doorway of the dust barrier system.

In an embodiment, the sheets of material of the first and second barrier panels comprises nylon taffeta.

BRIEF DESCRIPTION OF THE DRAWINGS

The foregoing and other objects, features and advantages of embodiments of the present inventive concepts will be apparent from the more particular description of preferred embodiments, as illustrated in the accompanying drawings in which like reference characters refer to the same elements throughout the different views. The drawings are not necessarily to scale, emphasis instead being placed upon illustrating the principles of the preferred embodiments.

DETAILED DESCRIPTION OF EMBODIMENTS

Figure 1:
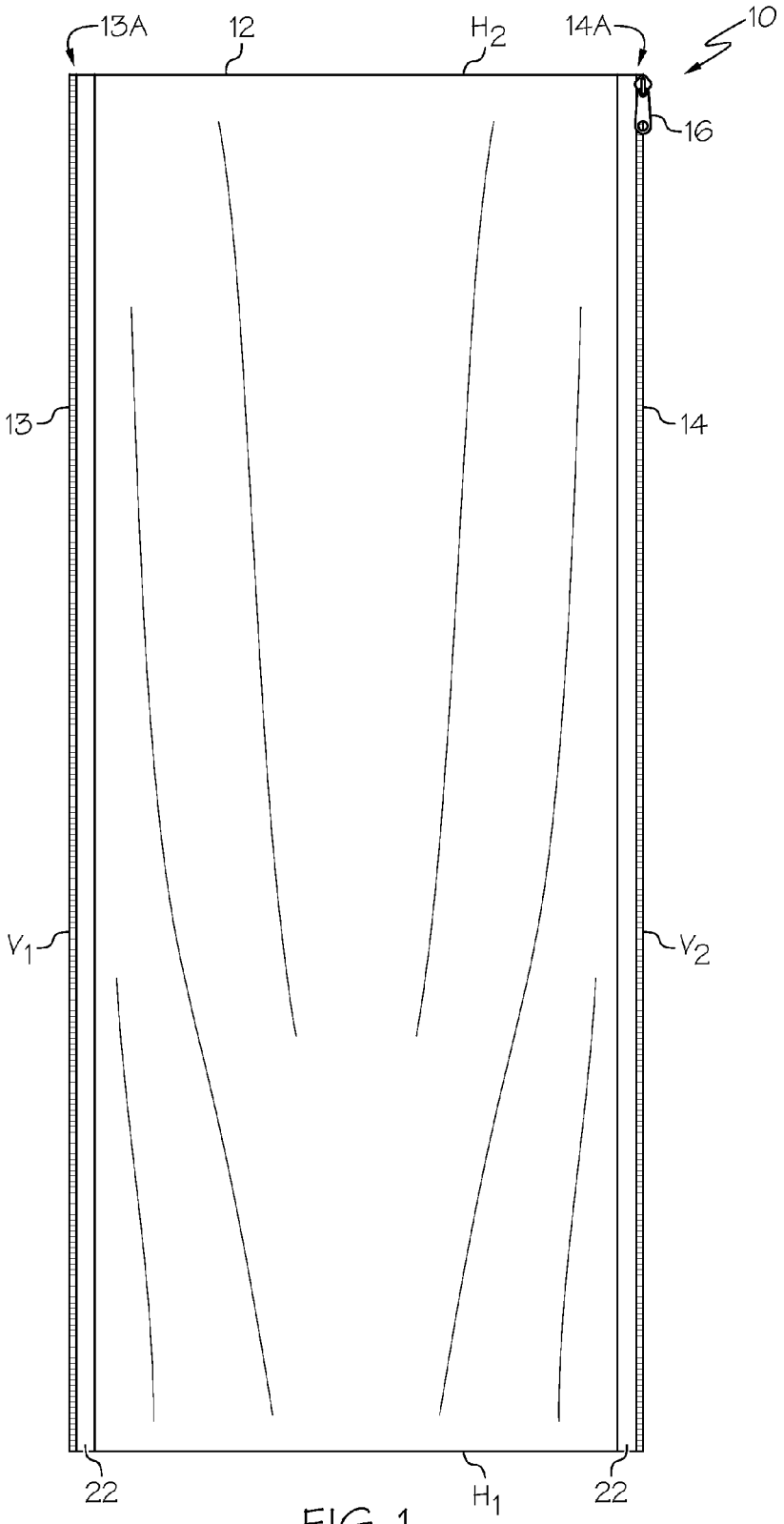
FIG. 1 is a front view of a barrier panel in accordance with embodiments of the present inventive concepts.

Various example embodiments will be described more fully hereinafter with reference to the accompanying drawings, in which some example embodiments are shown. The present inventive concepts may, however, be embodied in many different forms and should not be construed as limited to the example embodiments set forth herein.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive concepts.

Spatially relative terms, such as "beneath," "below," "lower," "above," "upper" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present inventive concepts. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of the present inventive concepts.

In systems and methods in accordance with the present inventive concepts, modular barrier panels may be used to construct a temporary or semi-permanent barrier in the vicinity of, or surrounding, a construction jobsite. In this manner, a barrier or enclosure can be provided. In some embodiments, the barrier panels may be combined to form a multiple-panel barrier system including a doorway to provide ingress and egress of workers from a partitioned area or zone. The doorway may itself be made of a barrier of the panel system. The barrier panels may be combined to form a barrier system of a desired size.

Figure 2:
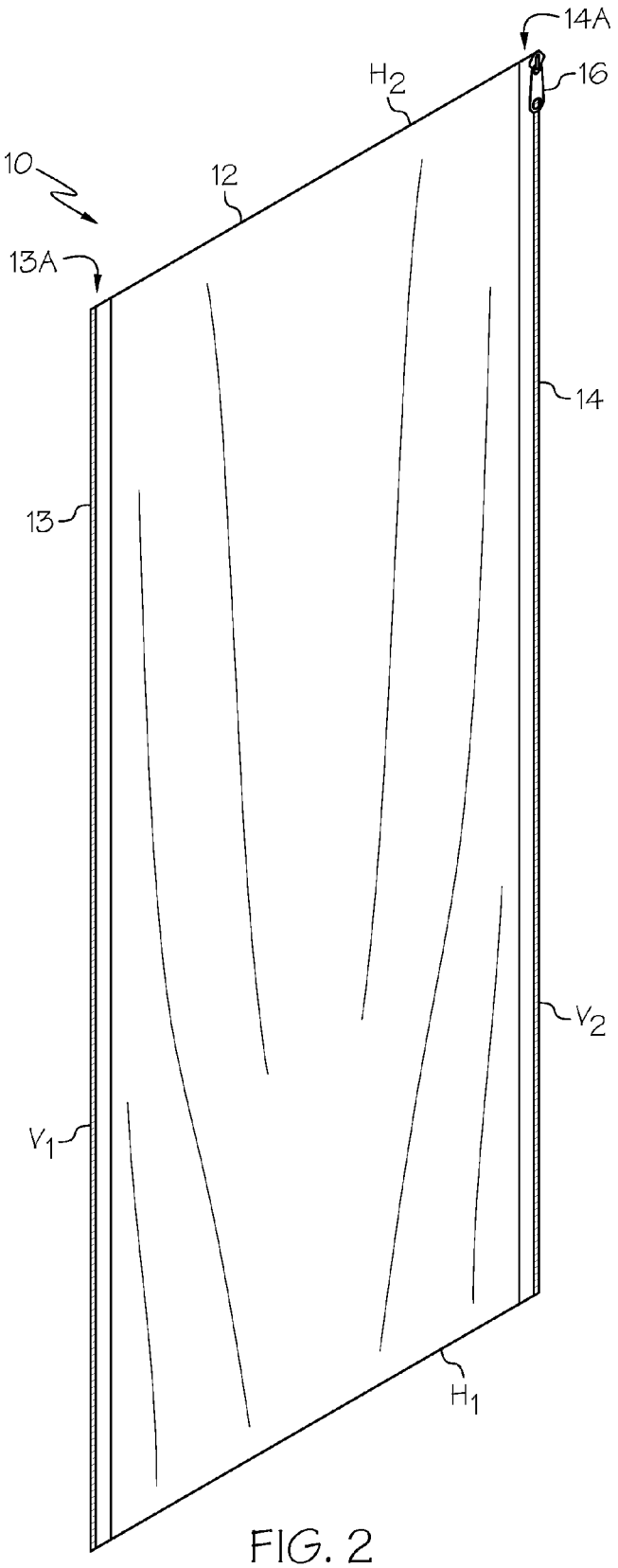
FIG. 2 is a perspective view of the barrier panel of FIG. 1A in accordance with embodiments of the present inventive concepts.
Figure 3:
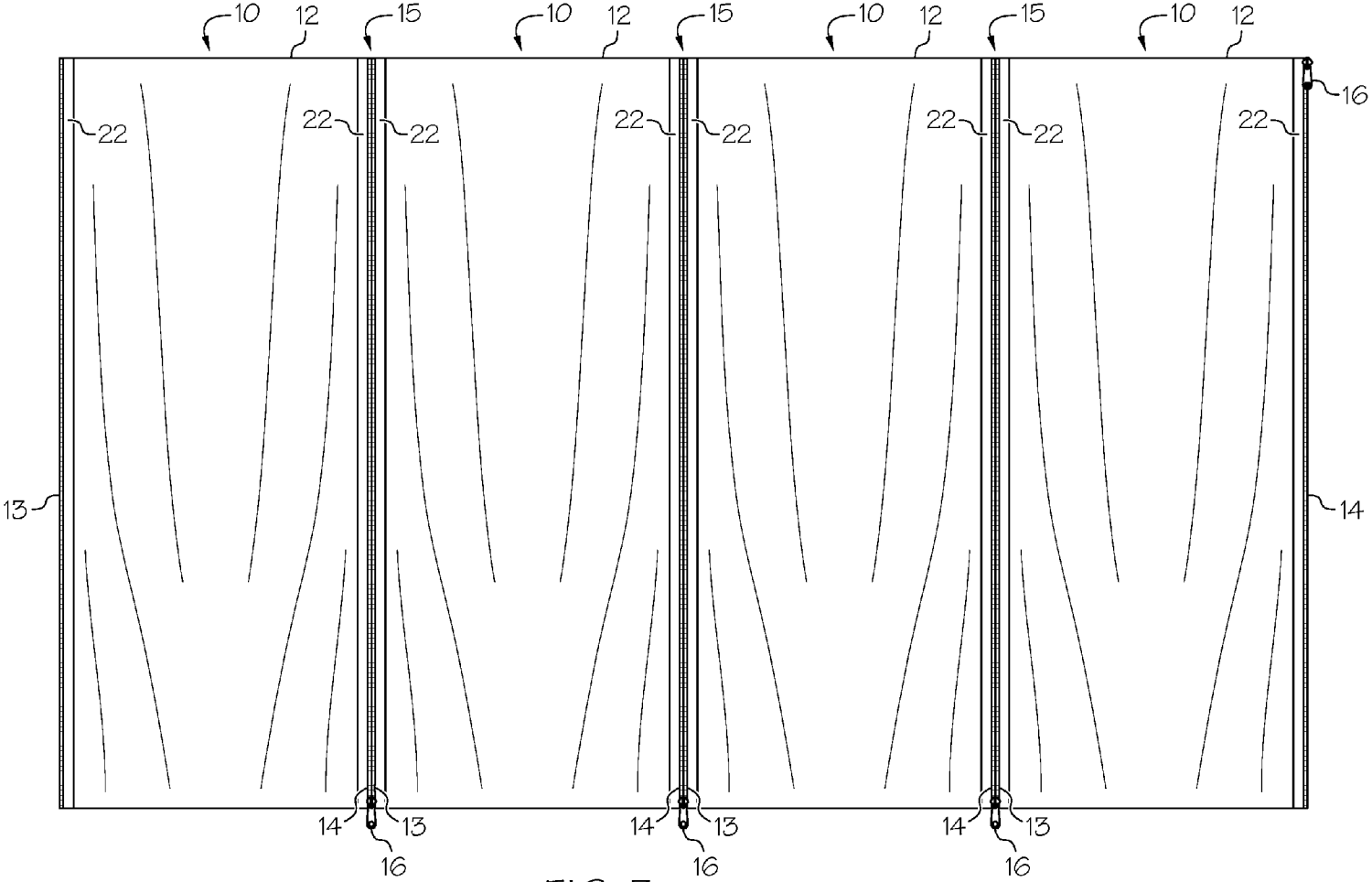
FIG. 3 is a front view of multiple barrier panels joined together to form a barrier system in accordance with embodiments of the present inventive concepts.

FIG. 1 is a front view of a barrier panel 10 in accordance with embodiments of the present inventive concepts. FIG. 2 is a perspective view of the barrier panel 10 of FIG. 1A in accordance with embodiments of the present inventive concepts. FIG. 3 is a front view of multiple barrier panels 10 joined together to form a barrier system in accordance with embodiments of the present inventive concepts.

The barrier panels 10 may be of a plurality of sizes. The sizes can be determined in accordance with the anticipated installation of the barrier system, whether it be residential, commercial, temporary, semi-permanent, etc. For example, the barrier panels may include 2.5' wide by 12' high barrier panels, 2.5' wide by 10' high barrier panels, 5' wide by 12' high barrier panels, 5' wide by 10' wide high barrier panels, 10' wide by 10' high barrier panels and/or 10' wide by 12' high barrier panels. The sizes of the barrier panels 10 are not limited to those stated herein, and the panels may be formed to any size suitable for an anticipated install.

A barrier panel 10 can include a sheet of material 12. A first zipper half 13A, including a first zipper teeth system 13 can be positioned at a first vertical edge V1 of the sheet of material 12. A second zipper half 14A, including a second zipper teeth system 14 can be positioned at a second vertical edge V2 of the sheet of material, the second vertical edge being opposite the first vertical edge. In some embodiments, the lower horizontal edge H1 and upper horizontal edge H2 are absent zipper teeth systems.

In some embodiments, the zipper halves 13A, 14A are mating halves of a zipper, which, when connected to corresponding mating halves of corresponding neighboring barrier panels, form a completed zipper 15 (see FIG. 3) that allows for joining of, and complete separation of, two neighboring panels. In some embodiments, the zipper 15 formed by zippers halves 13A, 14A of neighboring barrier panels 10 form an open-end separator type zipper of the type described by YKK Corporation, Chicago, Ill., at http://www.ykkfastening.com/products/tyes/s_zipper.html. In some embodiments, the zipper 15 forms a two-way separator type zipper. In other embodiments, other suitable zipper types may be applied.

Figure 11A:
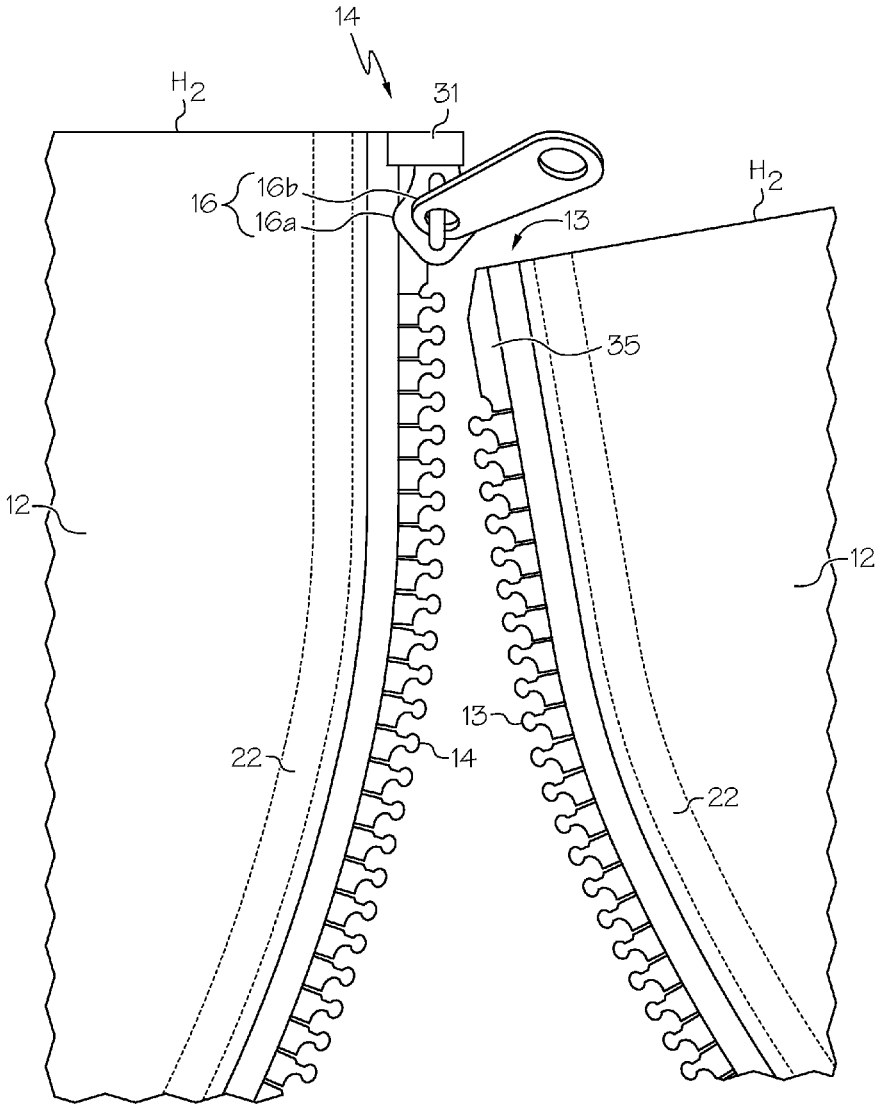
FIGS. 11A and 11B are close-up views of zipper teeth of first and second barrier panels being zipped together in accordance with embodiments of the present inventive concepts.
Figure 11B:
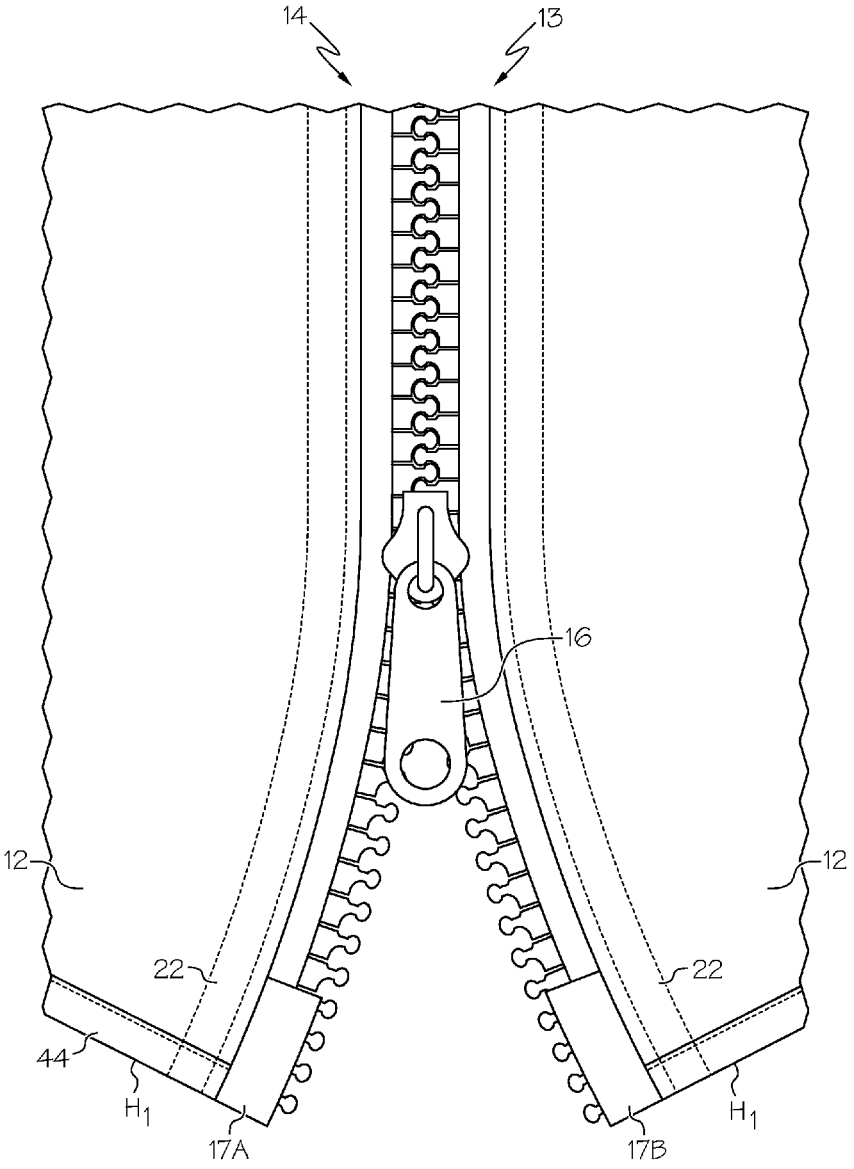

A standard zipper 15 includes a series of interlocking elements, or teeth, that are mounted to a backing, or zipper tape 22 (see FIG. 11). A zipper slider 16 meshes and separates the interlocking teeth 13, 14. Some sliders 16 include a pull 16A to provide a leverage point that pivots on a slider body 16B for adjusting the position of the slider 16. Separator-type zippers include a retaining box 31 at a top horizontal edge H2 of a first of the teeth systems 14 and an interlocking pin 35 at a top horizontal edge H2 of the second of the teeth systems 13 The zipper halves can be joined and separated by inserting the interlocking pin 35 through the slider and retaining box 31. Bottom stops 17A, 17B, as illustrated in FIG. 11B, at the first horizontal edge H1 prevent the slider 16A from sliding off the bottom region of the zipper. In the embodiments shown, the zipper half 14A includes the box pin and the slider 16A and the zipper half 13A includes the interlocking pin and no slider. An assembly of four barrier panels 10 can be seen in the embodiment of FIG. 3. In this view, it can be seen that the mating zipper halves 13A, 14A of neighboring panels can be joined to secure the panels to each other. In this view, it can also be seen that the panels are joined at their first and second vertical edges V1, V2, and are devoid of joining components, for example other zipper halves, in the region between their first and second vertical edges V1, V2.

Figure 4:
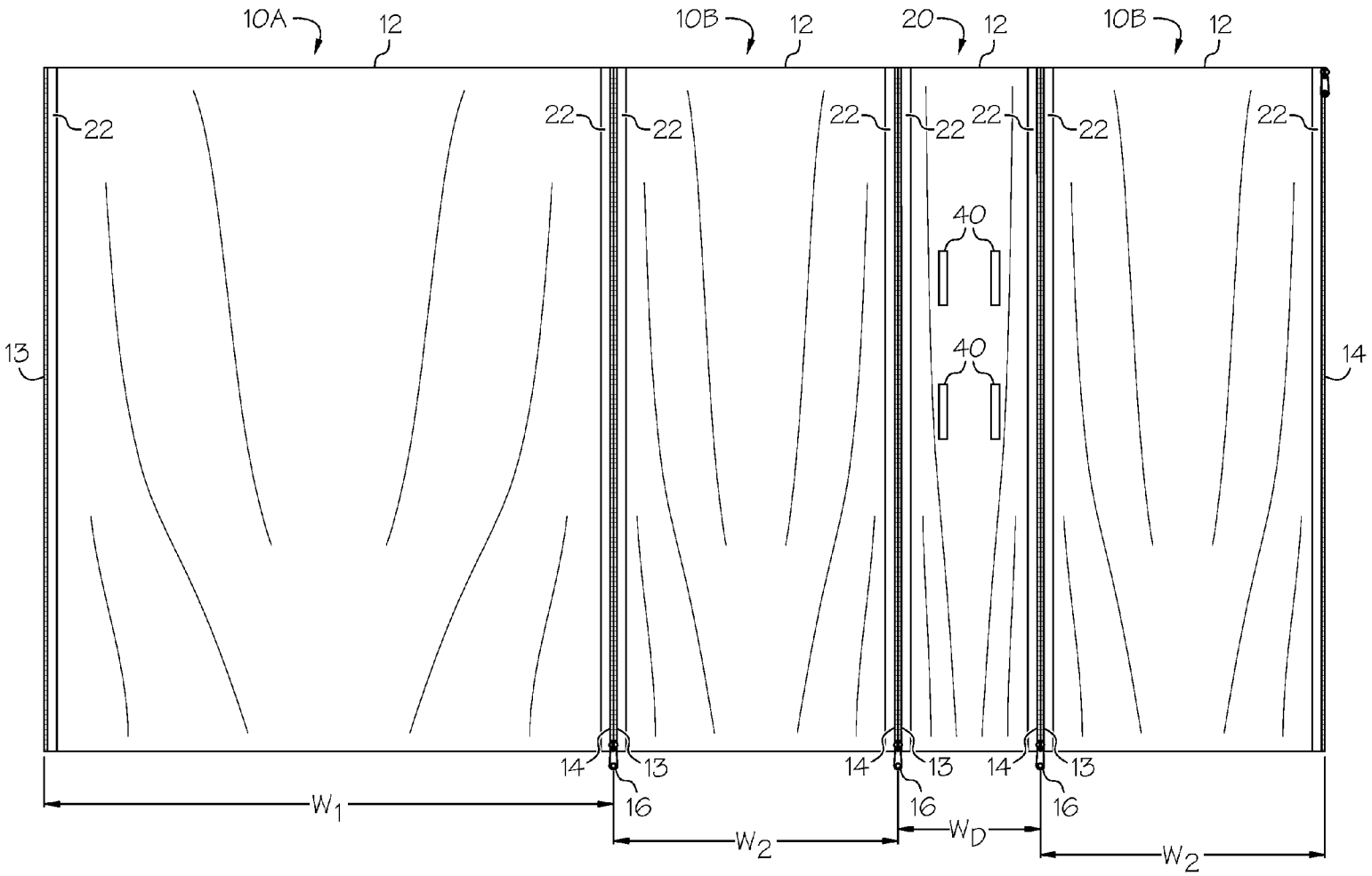
FIG. 4 is a front view of multiple barrier panels including doorway panel joined together to form a barrier system in accordance with embodiments of the present inventive concepts.
Figure 8:
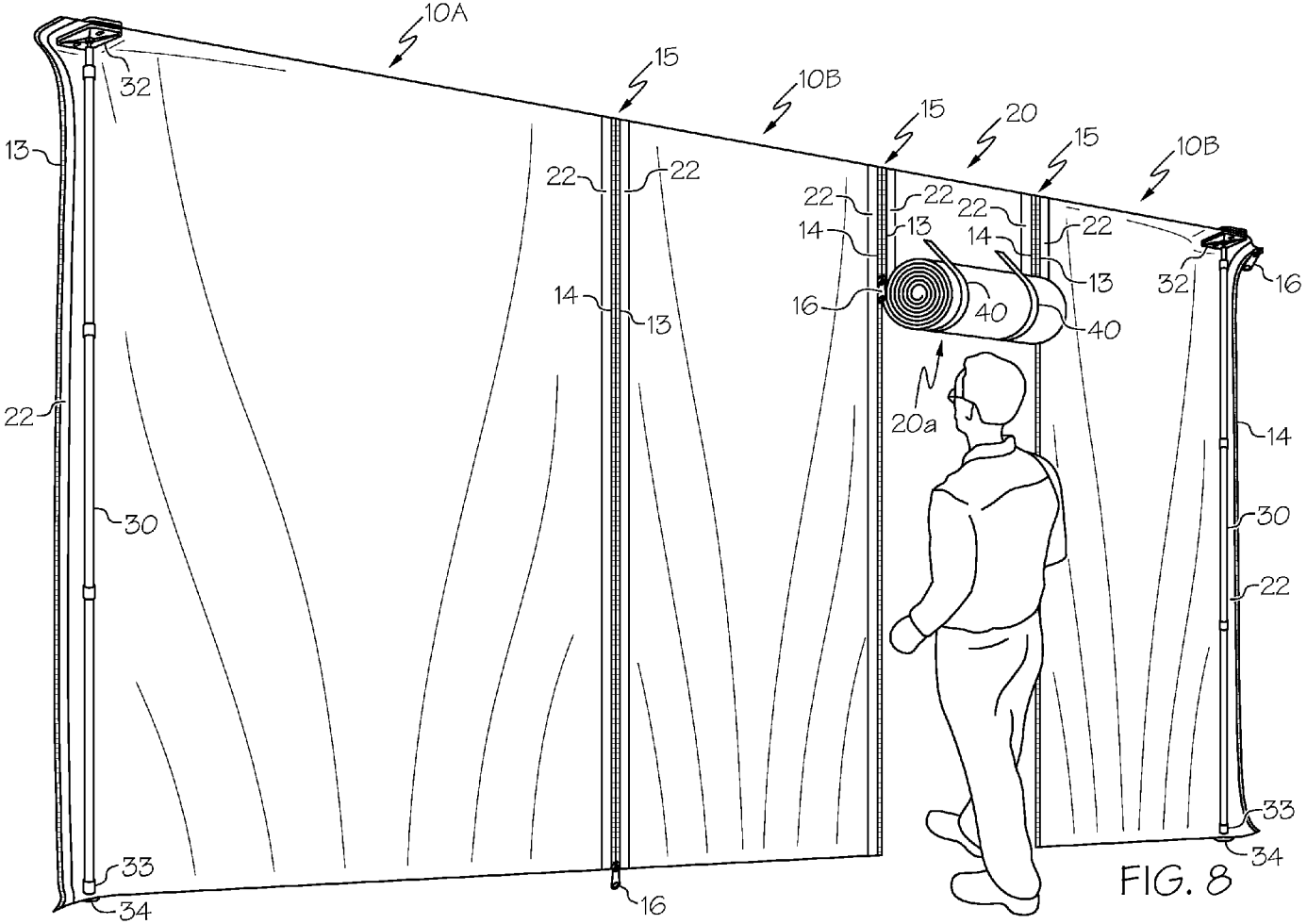
FIG. 8 is a perspective view of the barrier of FIG. 7 in an open position in accordance with embodiments of the present inventive concepts.

FIG. 4 is a front view of an installation including multiple barrier panels 10A, 10B joined together to form a barrier system, and further including a doorway panel 20 in accordance with embodiments of the present inventive concepts. In this embodiment, it can be seen that a first barrier panel 10A is relatively large in width $W_1$, relative to a width $W_2$ of the second barrier panels 10B. Installed between second barrier panels is a relatively narrow doorway panel 20 having a width $W_D$. The doorway panel 20 is narrow enough so that its lower portion can be readily rolled up into a roll 20A, as shown in FIG. 8, but, at the same time is wide enough so that materials can be readily transferred therethrough, and so that users can readily egress and ingress the work zone. In some embodiments, the doorway panel 20 may be the same width as either or both of the neighboring barrier panels 10A, 10B. In some embodiments, the doorway panel 20 can be wider than the barrier panels 10A, 10B or narrower than the barrier panels 10A, 10B. For purposes of the present description, the width of a panel is measured as its width from the first vertical edge V1 to the second vertical edge V2.

In some embodiments, the barrier panels 10, 20 are ruggedized for longevity and are therefore reusable. In other embodiments, the barrier panels 10, 20 are constructed for one-time use and are disposable.

In some embodiments, the barrier panels 10, 20 can be formed of durable material. In some embodiments, the sheet of material 12 of the barrier panels 10, 20 may comprise a ruggedized Nylon material. In some embodiments, the sheet of material 12 of the barrier panels 10, 20 may comprise a nylon taffeta. In some embodiments, the sheet of material 12 of the barrier panels 10, 20 may comprise rip-stop, nylon or rip-stop, nylon taffeta. In some embodiments, the sheet of material of the barrier panels 10, 20 may comprise a synthetic or natural fabric material. In some embodiments, the barrier panels 10, 20 may comprise a plastic material. In general, the taffeta or fabric materials have a more supple and softer feel, and may serve to provide an installation that is relatively more quiet when subjected to a passing breeze or incidental touching In some embodiments, the sheet of material 12 of the barrier panels 10, 20 may be opaque such that a sectioned off work area is shielded from view, thereby providing a private, clean and professional appearance for the work site.

The bottom portion of the barrier panels 10, 20 may have a hem 44, as illustrated in FIG. 11B, thereby creating a clean and professional look, and mitigating future fray of the material of the barrier panels 10. 20.

In some embodiments, the material 12 of the barrier panels 10, 20 may be selected so the installation can be configured to have a negative air zone. That is, the barrier panels 10, 20 may be used to create rooms with negative room pressure, which is an isolation technique used to prevent cross-contaminations from room to room. An air flow can be created that flows in a single direction by generating negative pressure to allow air to flow into the room but not escape from the room, thereby preventing contaminated air from escaping the room. Air is drawn into the work zone from outside the barrier, and the drawn-in air is pushed to an ambient air region, e.g. outside. This ensures that air is prevented from passing from the work zone within the barrier to the clean zone outside the barrier. To accomplish this, the material 12 is selected so that air-flow through the panels 12 and zippers 13A 14A is minimized.

In some embodiments, the barrier panels 10, 20 may be machine washable. In some embodiments, the material of the barrier panels 10, 20 may be a flame-retardant material. In some embodiments, the material of the barrier panels 10, 20 may be a tear/puncture resistant material. In some embodiments, the barrier panels 10, 20 may be formed of an impermeable or semi-permeable material. In some embodiments, the material of the barrier panels may be air-tight or water tight material.

In embodiments, the barrier panels 10, 20 may be combined to form a barrier of any length. While the barrier panels 10, 20 are illustrated as being attached to each other by zippers, the barrier panels may be attached, for example, by magnets, magnetic strips or other suitable closure mechanisms. In some embodiments, the closure mechanisms may include sewn-in heavy-duty zippers.

Figure 10:
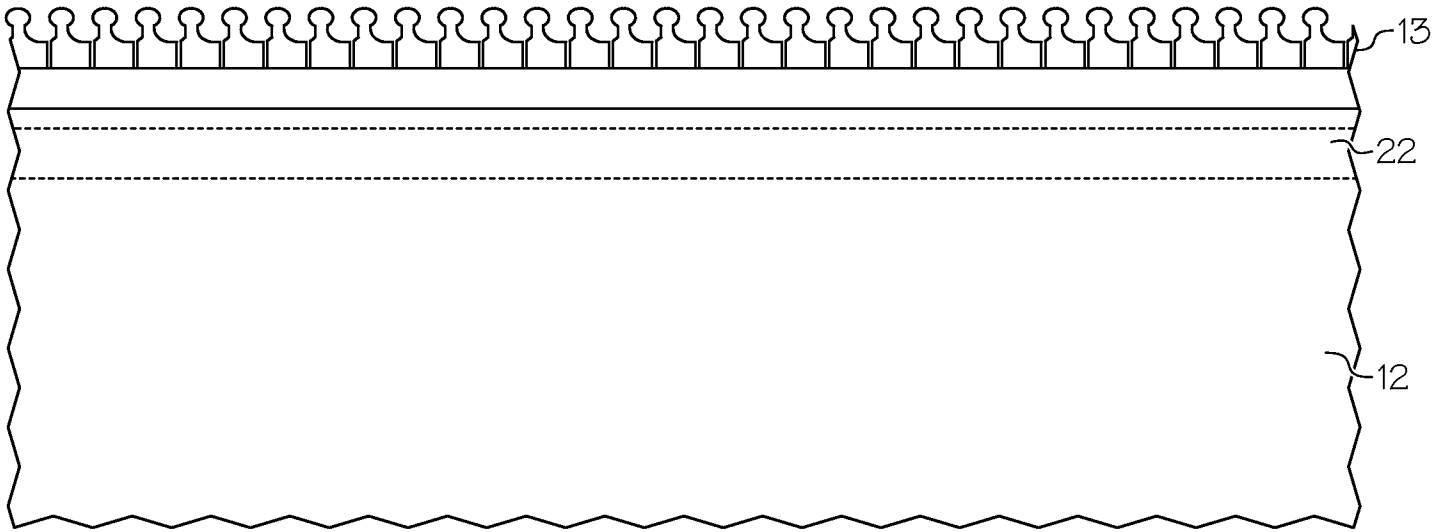
FIG. 10 is a close-up view of the zipper teeth of the barrier panes in accordance with embodiments of the present inventive concepts.

FIG. 10 is a close-up view of the first and second zipper halves 13A, 14A of the barrier panels 10, 20 in accordance with embodiments of the present inventive concepts. FIGS. 11A and 11B are close-up views of the first and second zipper halves 13A, 14A of first and second barrier panels 10, 20 in the process of being zipped together in accordance with embodiments of the present inventive concepts.

In some embodiments, the barrier panel 10, 20 may include the first zipper half 13 on the first vertical edge V1 of the sheet of material 12 of the barrier panel 10, 20 and the second zipper half 14 on the second vertical edge V2 of the barrier panel 10. One of the first and second zipper teeth systems 13, 14 of a first barrier panel 10, 20 may be mated with the other of the first and second zipper teeth systems of a neighboring barrier panel 10, 20. In the embodiments shown, the zipper half 14A of the barrier panel 10, 20 includes the retaining box 31 and the slider 16 and the zipper half 13A of the barrier panel 10, 20 includes the interlocking pin and no slider. The interlocking pin of the first zipper teeth system 13 of the barrier panel 10, 20 may be inserted into the slider 16 of another barrier panel 10, 20 and may be mated with the second zipper teeth system 14 of the other barrier panel 10, 20.

In some embodiments, the vertical edge of the barrier panel 10, 20 includes a zipper segment having zipper tape 22 to which the zipper teeth 13, 14 are attached, respectively. The zipper teeth 13, 14 may take the form of individual nylon, polyester or metal teeth, or can be shaped in the form of continuous nylon or polyester coils, or can comprise other suitable teeth materials and configurations. In some embodiments, the teeth of the first and second zipper halves 13, 14 may be formed using a mold. In some embodiments, the tape 22 may comprise cloth, fabric, reinforcement, nylon mesh, polyester mesh and other suitable materials.

The slider 16 is constructed and arranged to be hand operated, and moves along the teeth of the second zipper half 14 of a first barrier panel 10, 20 and the teeth of the first zipper half 13, or mating portion, of a second barrier panel 10, 20 to mesh together, or separate, the teeth portions of the first barrier panel and the second barrier panel. For example, the zipper slider 16 may comprise a Y-shaped channel that meshes together or separates the teeth of the second zipper half 14 of the first barrier panel and the teeth of the first zipper half 13 of the second barrier panel depending on a direction of movement of the slider 16. A label may be on the barrier panels indicating to top of each zipper, thereby indicating the side of the teeth of the first zipper half 13 that is to be inserted in the slider 16.

In some embodiments, the zipper tape 22 may be attached to the sheet of material 12 by sewn stitches, welding, glue, epoxy or other suitable attachment mechanisms. In some embodiments, the teeth of the first and second zipper teeth systems 13, 14 may be welded to the tape 22. The teeth of the first and second zipper teeth systems 13, 14 may be coupled to the tape 22 by melting the teeth material together with the tape material, for example, through the use of pressure and heat.

In operation, the barrier panels 10, 20 may be mounted using various partition mounting systems. In some embodiments, the barrier panels 10, 20 may be mounted using partition mounting systems described in connection with U.S. Pat. No. 5,924,469, U.S. Pat. No. 7,658,219, U.S. Pat. No. 7,717,382, U.S. Pat. No. 7,073,758 and U.S. Pat. No. 7,533,712, the contents of each being incorporated herein by reference in their entirety.

Figure 5:
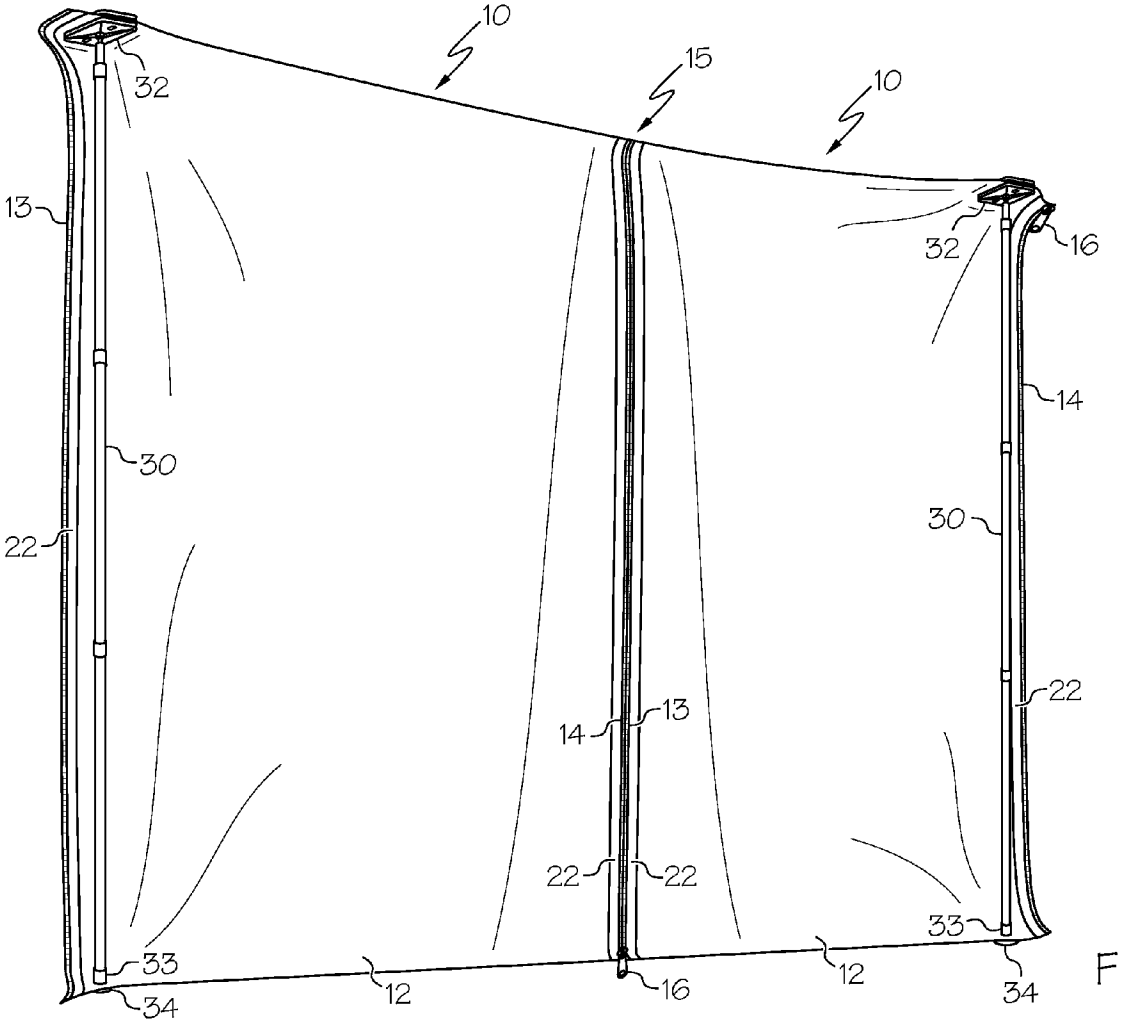
FIG. 5 is a perspective view of an installed barrier having barrier panels in a closed position in accordance with embodiments of the present inventive concepts.
Figure 6:
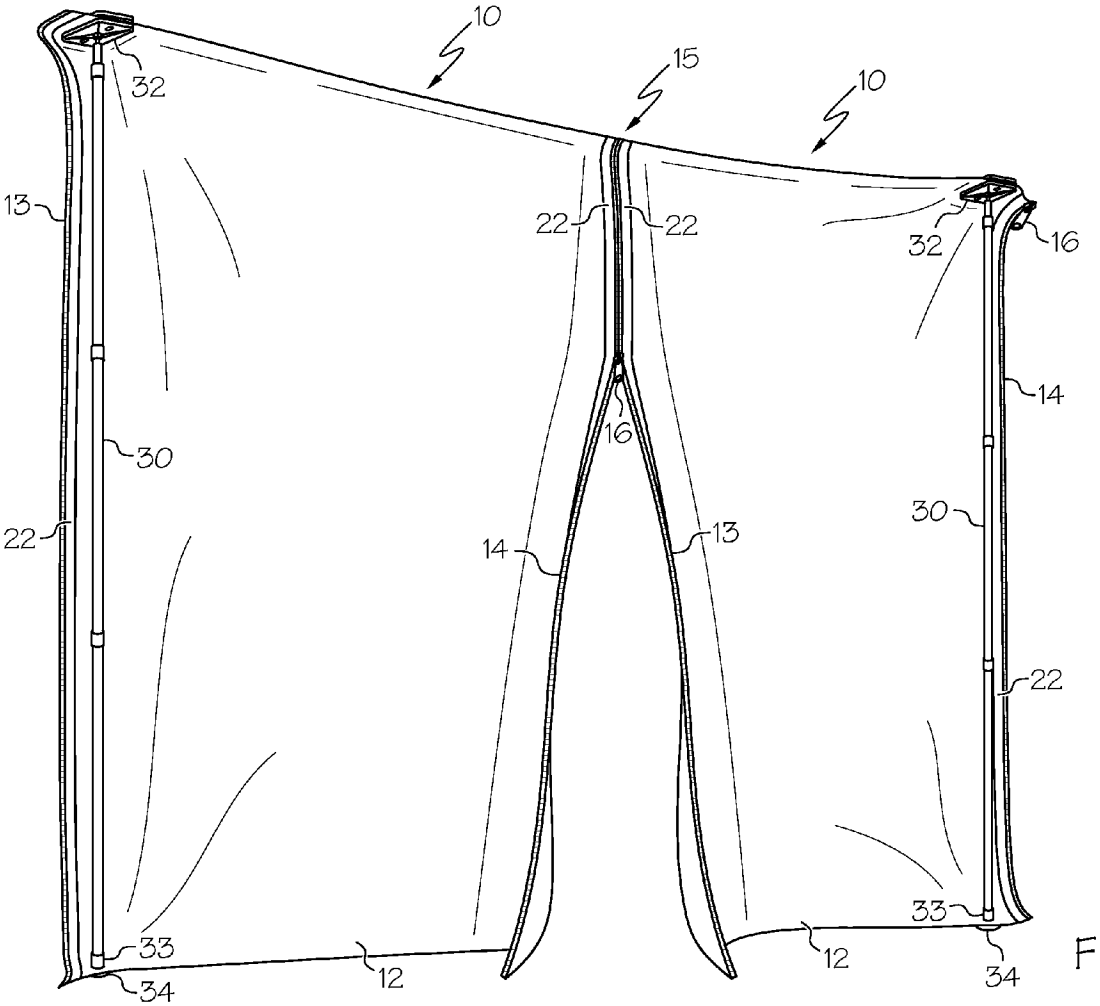
FIG. 6 is a perspective view of the barrier of FIG. 5 in an open position in accordance with embodiments of the present inventive concepts.
Figure 7:
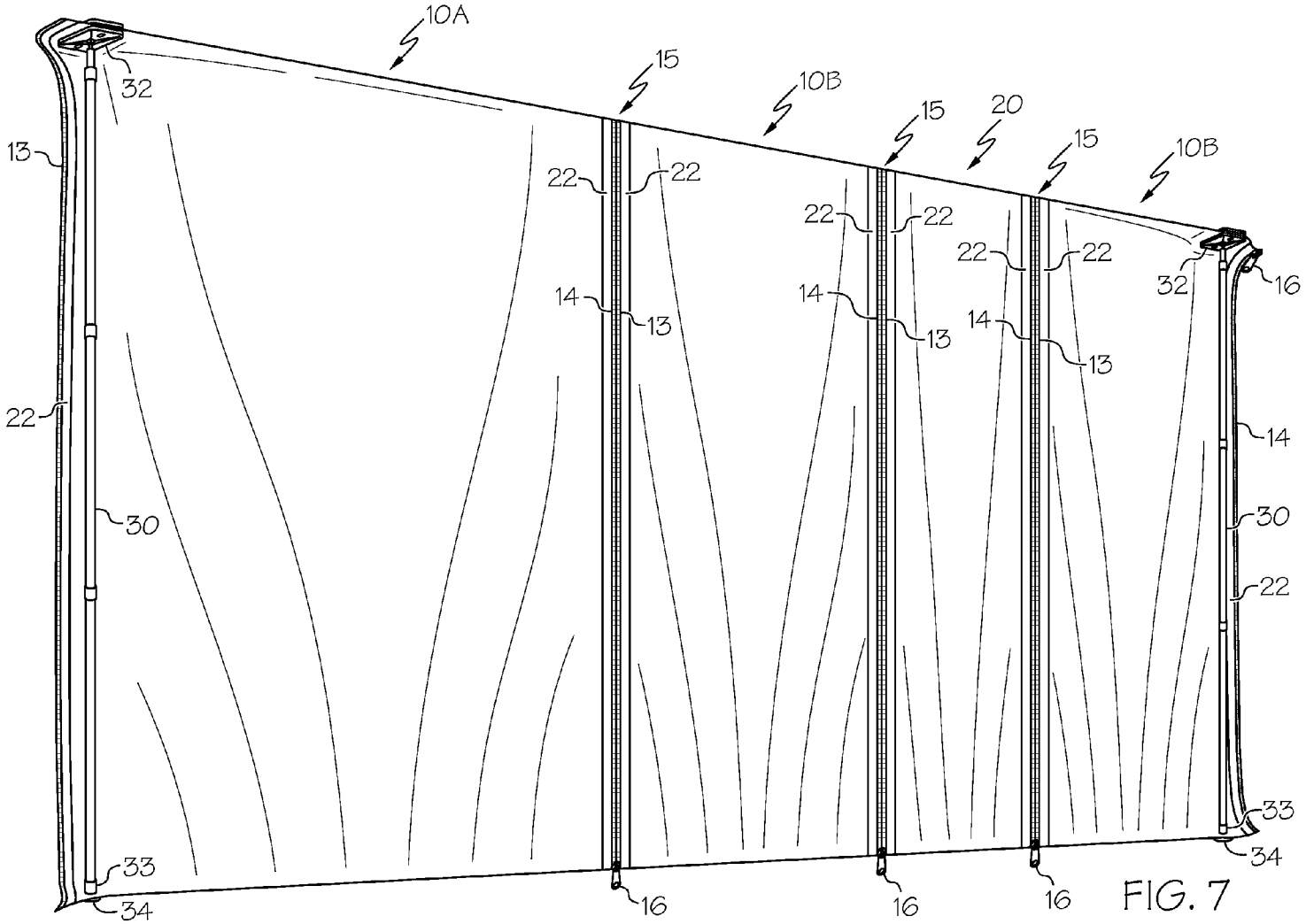
FIG. 7 is a perspective view of an installed barrier having barrier panels including a doorway panel in a closed position in accordance with embodiments of the present inventive concepts.

FIG. 5 is a perspective view of an installed barrier having barrier panels 10, 20 in a closed position in accordance with embodiments of the present inventive concepts. FIG. 6 is a perspective view of the barrier of FIG. 5 in an open position in accordance with embodiments of the present inventive concepts. FIG. 7 is a perspective view of an installed barrier having barrier panels 10, 20 including a doorway panel 20 in a closed position in accordance with embodiments of the present inventive concepts. FIG. 8 is a perspective view of the barrier of FIG. 7 in an open position in accordance with embodiments of the present inventive concepts. In some embodiments, the doorway panel 20 may include tabs 40, for example, sewn-in tabs, for holding the door way panel out of the way. In some embodiments, the tabs 40 may be Velcro® brand hook-and-loop type tabs or straps.

In the various installation configurations disclosed herein, a top portion of the barrier panel 10, 20 may be positioned between a head and a clip 32 of, for example, a spring-loaded pole 30. This may be performed at ground level, by an installer, and, once clipped, can be raised to the ceiling and placed in approximate position. The pole can be adjusted in length by the installer, so that the spring in the pole is compressed slightly when the pole is installed between the ceiling and floor. Once installed, a foot 33 of the pole 30 may be positioned over a bottom portion of the barrier panel 10. The foot 33 and bottom portion of the barrier may, in turn, be positioned over an anti-skid GripDisk™, grip or cup for gripping the surface of the floor with the barrier panel 10, 20 therebetween. Starting at one end of the barrier panels, the poles are lifted into position, one-by-one, secured between the floor and ceiling, and then placed so that the foot of the pole rests on the barrier panel directly over its corresponding, optional, GripDisk™, grip or cup. In this manner, the barrier panels 10, 20 are held vertically in place. By positioning the lower portion of the barrier panel between the foot of the pole and the floor, the panels are held securely in place.

Figure 9:
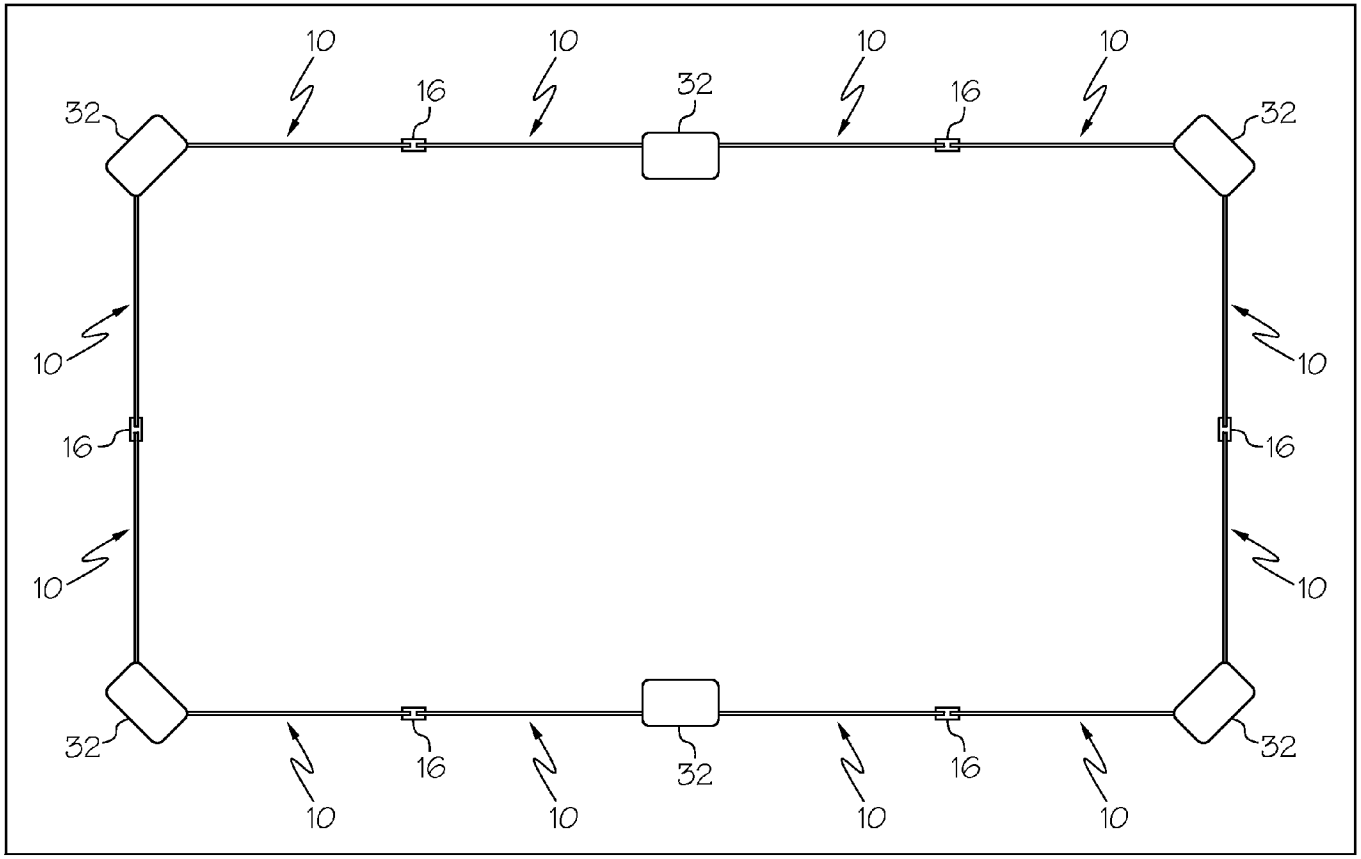
FIG. 9 is a top view of a room created by barrier panels in accordance with embodiments of the present inventive concepts.

FIG. 9 is a top view of a space or room created by barrier panels 10, 20 in accordance with embodiments of the present inventive concepts. In some embodiments, the barrier panels 10, 20 and poles 30 may be used to create a room within a room, as illustrated in FIG. 9. The poles 30 may be used define a space and the barrier panels 30 may be connected such that the first barrier panel 10, 20 in the series is connected to the final barrier panel 10, 20 in the series, thereby creating an enclosed space. In some embodiments, one or more doorway panels 20 may be used as one of the panels.

FIGS. 12-17 are perspective views illustrating installation of barrier panels 10, 20 as a barrier in accordance with embodiments of the present inventive concepts.

Figure 12:
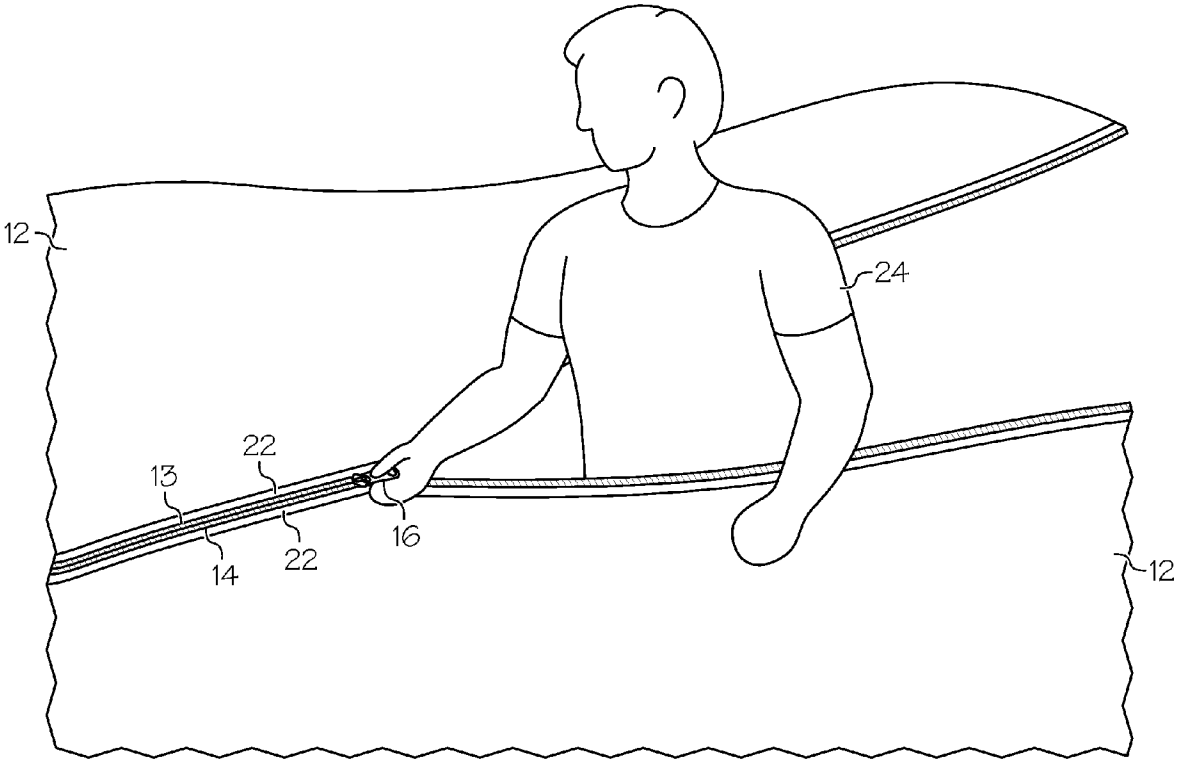
FIGS. 12-17 are perspective views illustrating installation of barrier panels as a barrier system in accordance with embodiments of the present inventive concepts.

The barrier panels 10, 20 are installed by, first, selecting a combination of barrier panels 10, 20 to give a desired barrier width. In some embodiments, the panel widths may be printed on the zippers to assist an installer with estimation of the overall barrier width prior to assembly Then, as illustrated in FIG. 12, with the sliders 16 at the top of the barrier panel 10, a user 24 may insert the mating portion, that is, the interlocking pin 35 of zipper teeth system 13, of a panel to be installed as a neighboring panel into the slider 16 and the corresponding retaining box 31. Then, the slider 16 is pulled towards the bottom of the barrier panel mating the second zipper teeth system 14 of the barrier panel 10, 20 with the first zipper teeth system 13 of the neighboring panel. This step is repeated with additional barrier panels 10, 20 until the barrier is complete. In some embodiments, an opening created by the zipper 15 between adjacent barrier panels 10, 20 is used as an opening for ingress and egress. In some embodiments, the doorway panel 20, for example, a 2.5' wide by 12' high barrier panel, is inserted in the barrier system where the doorway is needed. The doorway panel 20 provides a larger, more well-defined, opening than the zipper itself such that a user 24 may more readily transport work materials therethrough.

Figure 13:
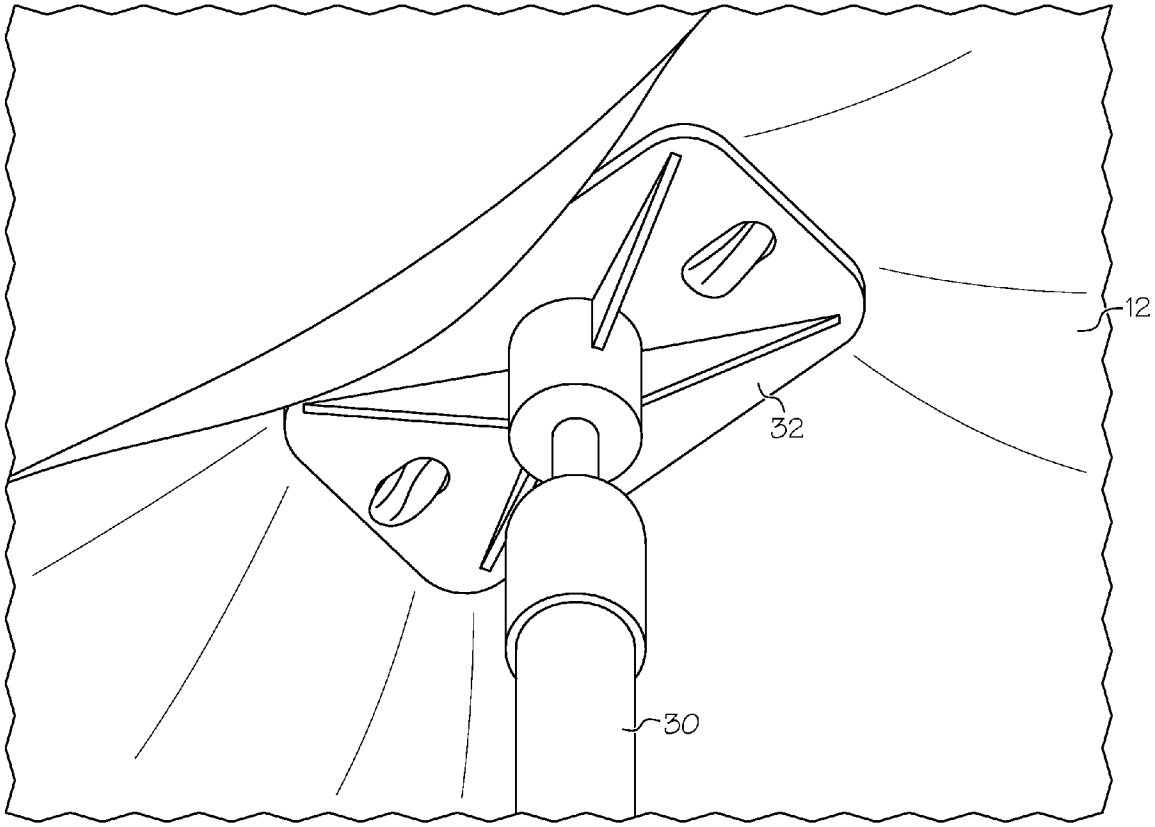

After coupling the neighboring panels, the spring-loaded pole 30, for example, those described in connection with U.S. Pat. No. 5,924,469 and U.S. Pat. No. 7,658,219, or other such poles are attached, for example, spaced every 8' to 10' apart and the barrier is raised into position. In some embodiments, approximately 6" of extra material is left to overhang at the ceiling and approximately 1' of extra material is left at both walls. As illustrated in FIG. 13, the barrier panels 10, 20 may be placed between a clip and a head 32. In some embodiments, the clip and head 32 may comprise a keyhole and slot and described in connection with U.S. Pat. No. 5,924,469 and U.S. Pat. No. 7,658,219. That is, apertures of the head are configured, or otherwise constructed and arranged, to receive pins of a clip. The barrier panel 10, 20 is placed between the clip and the head 32. In some embodiments, the barrier panels 10, 20 comprise a thickness and material such that the barrier panels are not torn or punctured by the pins of the clip. The foot 33 of the pole 30 can positioned over a portion of the barrier panels 10, 20 to secure the barrier panels 10, 20 in place in a more rigid configuration that is more resistant to ambient air flow.

Figure 14:
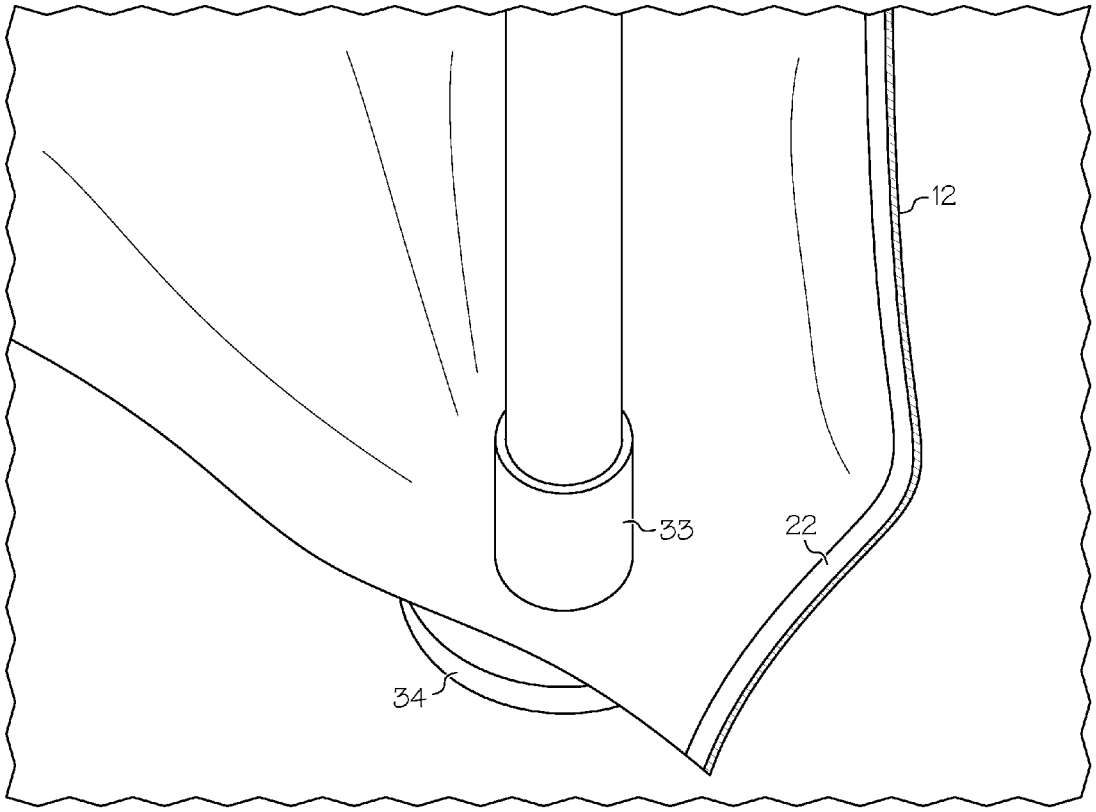

As illustrated in FIG. 14, then, the remaining material of the barrier panel 10, 20 at the floor may be rolled-up. In some embodiments, the anti-skid GripDisks™, grips or cups for gripping the surface of the floor may be placed under the remaining material at the floor. Starting at one end of the barrier panels, the poles are lifted and then lowered so that the foot of the pole rests on the material directly over the GripDisks™, grips or cups. Such grips provide additional system rigidity and resistance to lateral forces.

Figure 15:
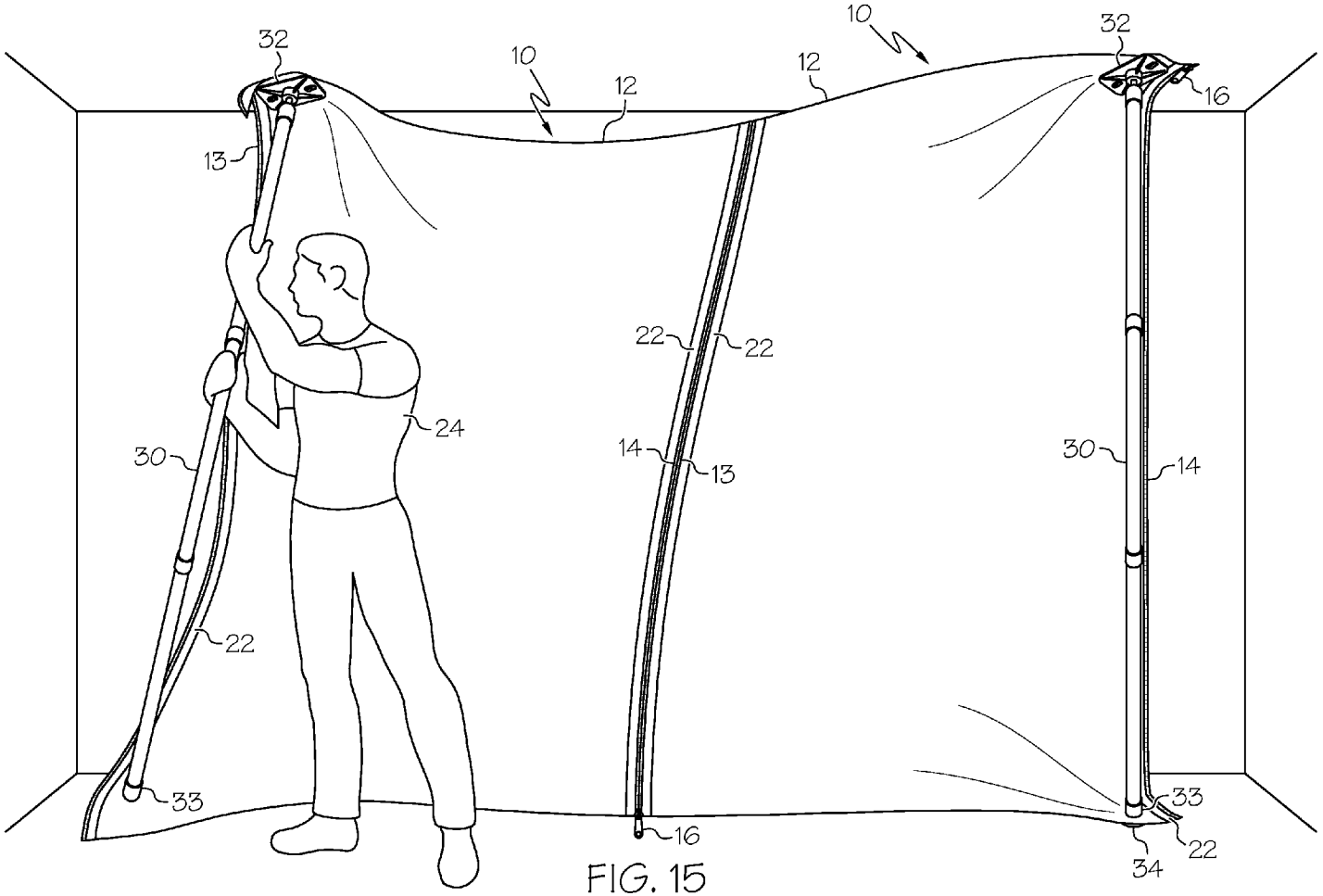

As illustrated in FIG. 15, the clip/head 32 may be positioned against the ceiling such that the pole 30 is positioned between the floor and the ceiling thereby holding the barrier panels 10, 20 in place.

Figure 16:
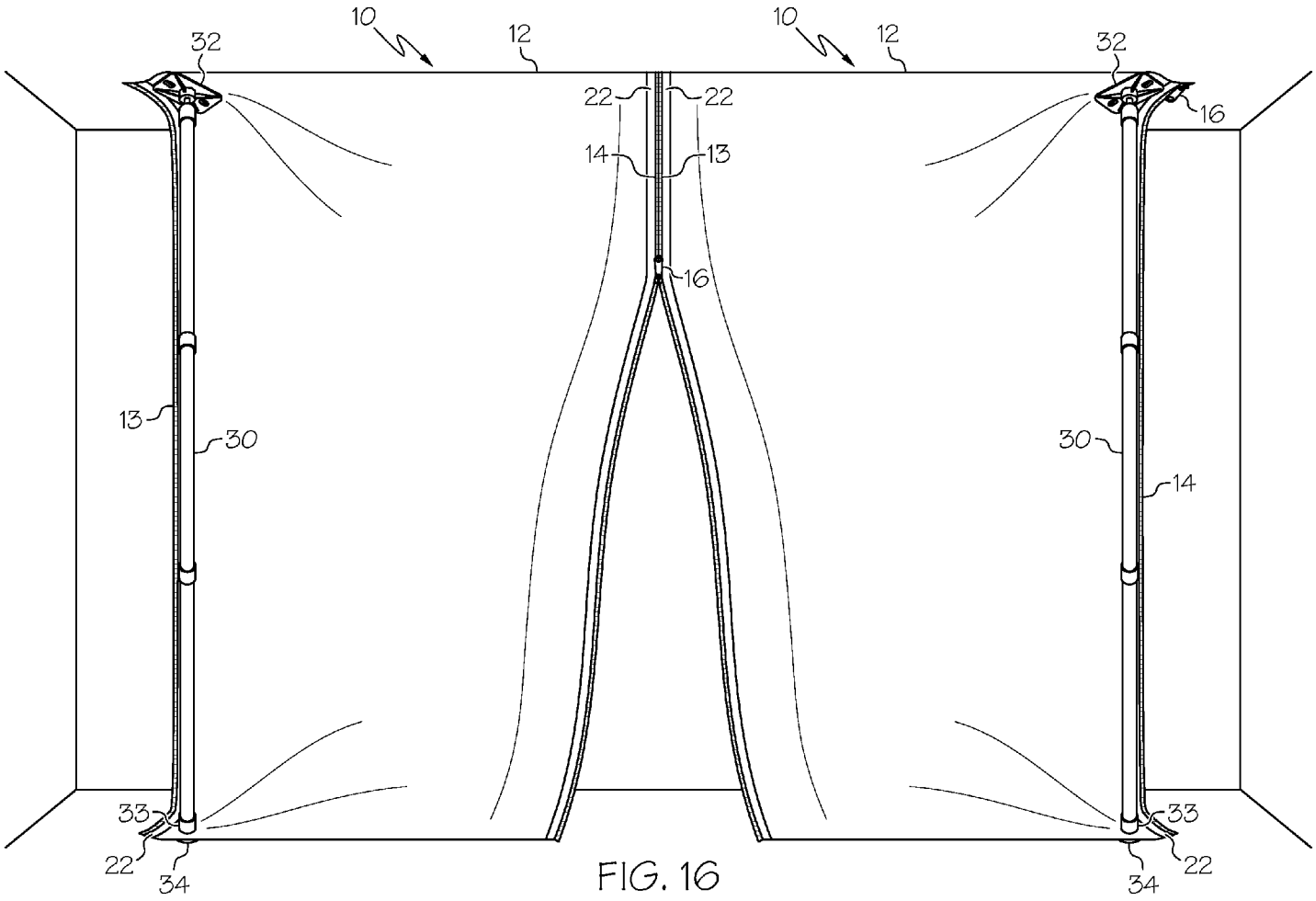

If a doorway panel 20 is not included, as illustrated in FIG. 16, the zipper between two adjacent barrier panels 10 may be unzipped to create an entry way.

Figure 17:
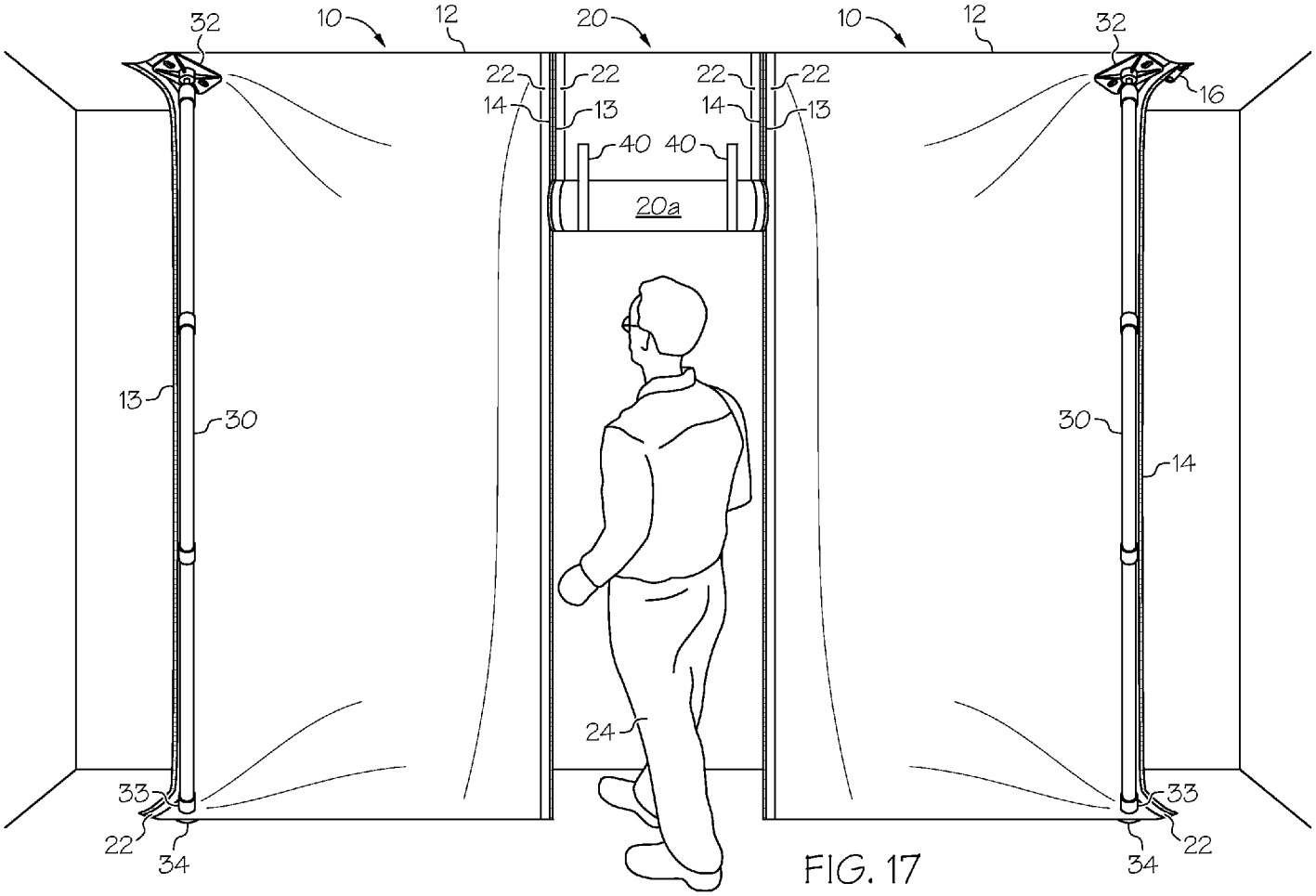

If a doorway panel 20 is included, as illustrated in FIG. 17, to open the doorway, both sides of the doorway panel 20 are zipped up and the panel 20 is rolled to the desired height for easy job site access. In some embodiments, the doorway panel may include the tabs 40, for example, sewn-in tabs, for holding the door way panel out of the way. In some embodiments, the tabs 40 may be Velcro® hook-and-loop type tabs.

Figure 18:
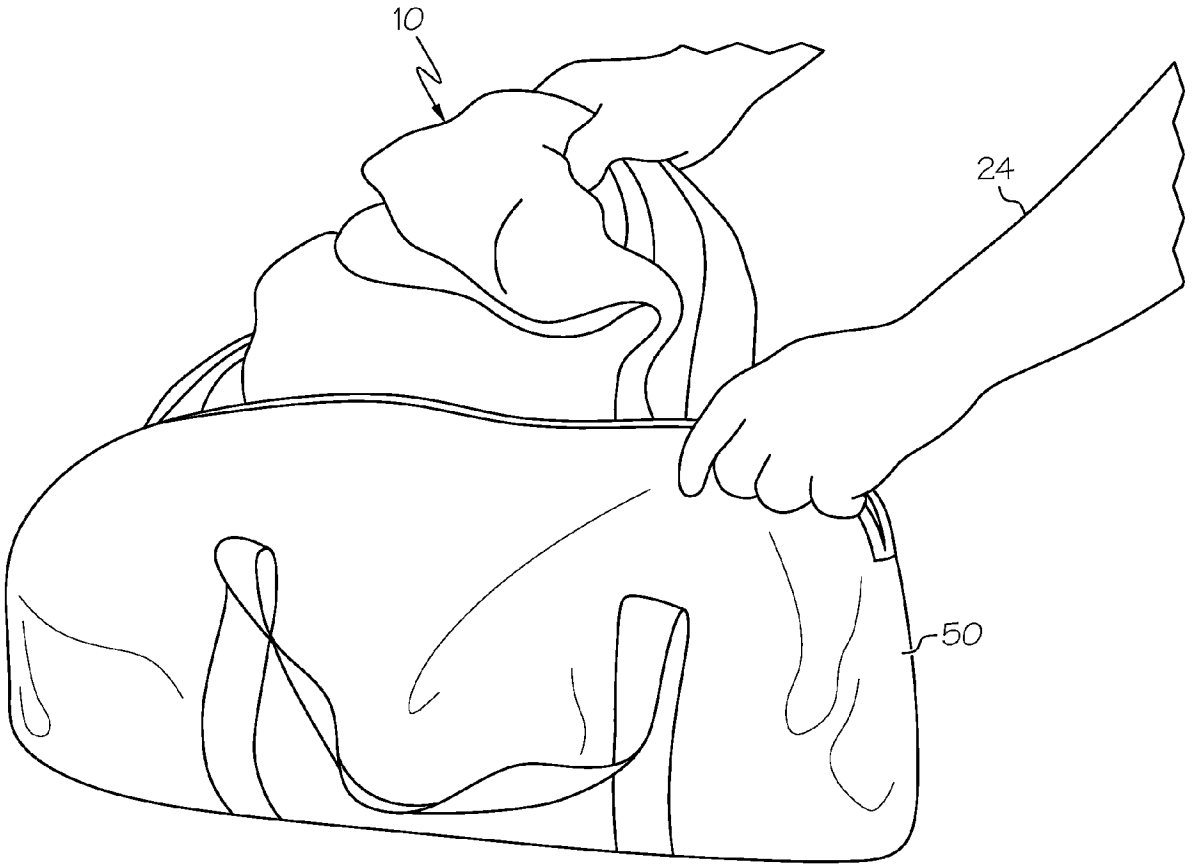
FIG. 18 is a perspective view of barrier panels being stored in a carrier bag in accordance with embodiments of the present inventive concepts.

When the barrier system is no longer needed, the barrier panels 10, 20 may be taken down and stored for later use. FIG. 18 is a perspective view of barrier panels 10, 20 being stored in a carrier bag 50 in accordance with embodiments of the present inventive concepts. In some embodiments, the barrier panels 10, 20 may be stored in the carry bag 50. In some embodiments, the barrier panels 10, 20 do not need to be folded but rather may be stuffed into the carry bag 50 by a user 24 and pulled out for the next use According to the inventive concepts described herein, reusable barrier panels may be combined by closure mechanisms, for example, sewn-in heavy duty zippers, to create a barrier system of a desired size.

While embodiments of the inventive concepts have been particularly shown and described with references to preferred embodiments thereof, it will be understood by those skilled in the art that various changes in form and details may be made herein without departing from the spirit and scope of the present inventive concepts as defined.

What is claimed is:

1. A dust barrier system comprising:

first and second barrier panels, wherein each of the first and second barrier panels comprises:

a sheet of material comprising nylon;

first zipper teeth extending from a first side of the sheet of material;

second zipper teeth extending from a second side of the sheet of material;

a zipper slider coupled to only one of the first zipper teeth and the second zipper teeth and configured to slide along the one of the first zipper teeth and the second zipper teeth; and bottom stops at the bottoms of the first zipper teeth and the second zipper teeth, wherein the first zipper teeth of the first barrier panel mate with the second zipper teeth of the second barrier panel, wherein the first and second barrier panels are combined to form a barrier, and the bottom stops are at a bottom horizontal edge of the barrier, and wherein, in an assembled state, at least one of the first and second barrier panels is positioned at an outermost edge of the barrier, and at least one of the second zipper teeth of the first barrier panel and the first zipper teeth of the second barrier panel extend from the outermost edge of the barrier, and first and second poles, each of the first and second poles having a head end and a foot end, in an assembled state, the first and second poles each having clips that removably secure a sheet of material respectively to support the first barrier panel and the second barrier panel between a first surface and a second surface such that the sheet of material of the first barrier panel is positioned between the head end of the first pole and the first surface and between the foot end of the first pole and the second surface and the sheet of material of the second barrier panel is positioned between the head end of the second pole and the first surface and between the foot end of the second pole and the second surface, the second pole being spaced apart and adjacent to the first pole such that the first side of the sheet of material of the first barrier panel and the second side of the sheet of material of the second barrier panel are mated at their respective zipper teeth at a position between the first pole and the second pole adjacent the first pole.

2. The dust barrier system of claim 1, wherein the first and second poles are spring-loaded poles, each of the first and second poles having a head and a foot.

3. The dust barrier system of claim 1, wherein the sheet of material comprises nylon taffeta.

4. The dust barrier system of claim 1, wherein the sheet of material is flame retardant.

5. The dust barrier system of claim 1, wherein the first and second zipper teeth extend from outermost edges of the first and second sides of the sheet of material.

6. The dust barrier system of claim 1, wherein the first and second barrier panels are reusable.

7. The dust barrier system of claim 1, wherein the sheet of material is opaque.

8. The dust barrier system of claim 1, further comprising a doorway panel combined with at least one of the first and second barrier panels, wherein the doorway panel has a width less than the first and second barrier panels and comprises:

a second sheet of material comprising nylon;

third zipper teeth extending from a first side of the second sheet of material;

fourth zipper teeth extending from a second side of the second sheet of material, and a second slider having a zipper pull coupled to only one of the third zipper teeth and the fourth zipper teeth and configured to slide along the one of the third zipper teeth and the fourth zipper teeth, wherein the one of the third zipper teeth and the fourth zipper teeth mate with the other of the first zipper teeth and the second zipper teeth of the first and second barrier panels, and wherein the other of the third zipper teeth the fourth zipper teeth mate with the one of the first zipper teeth and the second zipper teeth of the first and second barrier panels.

9. A method of installing a dust barrier system comprising:

combining first and second barrier panels to form a barrier, wherein each of the first and second barrier panels comprises:

a sheet of material comprising nylon;

first zipper teeth extending from a first side of the sheet of material;

second zipper teeth extending from a second side of the sheet of material;

a slider coupled to only one of the first zipper teeth and the second zipper teeth and configured to slide along the one of the first zipper teeth and the second zipper teeth; and bottom stops at the bottoms of the first zipper teeth and the second zipper teeth, wherein combining first and second barrier panels comprises mating the first zipper teeth of the first barrier panel with the second zipper teeth of the second barrier panel using the zipper pull such that the bottom stops are at a bottom horizontal edge of the first and second barrier panels, and wherein, in an assembled state, at least one of the first and second barrier panels is positioned at an outermost edge of the barrier, and at least one of the second zipper teeth of the first barrier panel and the first zipper teeth of the second barrier panel extend from the outermost edge of the barrier, inserting the sheet of material of the first barrier panel between a clip and a head of a first spring-loaded pole, positioning a foot of the first spring-loaded pole over the sheet of material of the first barrier panel and positioning the first spring-loaded pole between a first surface and a second surface; and inserting the sheet of material of the second barrier panel between a clip and a head of second spring-loaded pole, positioning a foot of the second spring-loaded pole over the sheet of material of the second barrier panel and positioning the second spring-loaded pole between the first surface and the second surface, the second spring-loaded pole being spaced apart and adjacent to the first spring-loaded pole such that the first side of the sheet of material of the first barrier panel and the second side of the sheet of material of the second barrier panel are mated at their respective zipper teeth at a position between the first spring-loaded pole and the second spring-loaded pole adjacent to the first spring-loaded pole.

10. The method of installing a dust barrier system of claim 9, wherein the sheet of material comprises nylon taffeta.

11. The method of installing a dust barrier system of claim 9, wherein the sheet of material is flame retardant.

12. The method of installing a dust barrier system of claim 9, wherein the first and second zipper teeth extend from outermost edges of the sheet of material.

13. The method of installing a dust barrier system of claim 9, wherein the first and second barrier panels are reusable.

14. The method of installing a dust barrier system of claim 9, wherein the sheet of material is opaque.

15. The method of installing a dust barrier system of claim 9, further combining a doorway panel with at least one of the first and second barrier panels, wherein the doorway panels has a width less than the first and second barrier panels and comprises:

a second sheet of material comprising nylon;

third zipper teeth extending from a first side of the second sheet of material;

fourth zipper teeth extending from a second side of the second sheet of material, and a second slider having a zipper pull coupled to only one of the third zipper teeth and the fourth zipper teeth and configured to slide along the one of the third zipper teeth and the fourth zipper teeth, wherein the doorway panel is combined with the at least one of the first and second barrier panels by mating one of the third zipper teeth and the fourth zipper teeth with the other of the first zipper teeth and the second zipper teeth of the first and second barrier panels, and by mating the other of the third zipper teeth the fourth zipper teeth with the one of the first zipper teeth and the second zipper teeth of the first and second barrier panels.

16. A dust barrier system comprising:

a first barrier panel comprising:

a sheet of material, a first zipper half at a first vertical edge of the sheet of material, a second zipper half at a second vertical edge of the sheet of material, the second vertical edge opposite the first vertical edge, a zipper slider slidably coupled to the second zipper half adapted to engage a mating first zipper half of a neighboring barrier panel, and bottom stops at the bottoms of the first zipper half and the second zipper half;

a second barrier panel comprising:

a sheet of material, a first zipper half at a first vertical edge of the sheet of material, a second zipper half at a second vertical edge of the sheet of material, the second vertical edge opposite the first vertical edge, a zipper slider slidably coupled to the second zipper half adapted to engage a mating first zipper half of a neighboring barrier panel, and bottom stops at the bottoms of the first zipper half and the second zipper half;

wherein the sheets of material of the first barrier panel and second barrier panel are devoid of zipper components on the sheet of material between the first zipper half and the second zipper half, wherein the first and second barrier panels are combined to form a barrier, and the bottom stops of the first zipper halves and the second zipper halves are at a bottom horizontal edge of the barrier, and wherein, in an assembled state, at least one of the first and second barrier panels is positioned at an outermost edge of the barrier, and at least one of the first zipper half and the second zipper half of one of the first barrier and the second barrier extends from an outermost edge of the barrier, and first and second poles, each of the first and second poles having a head end and a foot end, in an assembled state, the first and second poles each having clips that removably secure a sheet of material respectively to support the first barrier panel and the second barrier panel between a first surface and a second surface such that the sheet of material of the first barrier panel is positioned between the head end of the first pole and the first surface and between the foot end of the first pole and the second surface and the sheet of material of the second barrier panel is positioned between the head end of the second pole and the first surface and between the foot end of the second pole and the second surface, the second pole being spaced apart and adjacent to the first pole such that the first side of the sheet of material of the first barrier panel and the second side of the sheet of material of the second barrier panel are mated at their respective zipper teeth at a position between the first pole and the second pole adjacent to the first pole.

17. The dust barrier system of claim 16 wherein the first barrier panel has a first width between the first zipper half and the second zipper half of the first panel, wherein the second barrier panel has a second width between the first zipper half and the second zipper half of the second panel, and further comprising:

a third barrier panel comprising:

a sheet of material, a first zipper half at a first vertical edge of the sheet of material;

a second zipper half at a second vertical edge of the sheet of material, the second vertical edge opposite the first vertical edge, and a zipper slider slidably coupled to the second zipper half adapted to engage a mating first zipper half of a neighboring barrier panel;

wherein the third barrier panel has a third width between the first zipper half and the second zipper half of the third panel, wherein the third width is less than the first width and wherein the third width is less than the second width.

18. The dust barrier system of claim 17 wherein the third width of the third barrier panel is sized to operate as a doorway of the dust barrier system.

19. The dust barrier system of claim 16, wherein the sheets of material of the first and second barrier panels comprises nylon taffeta.

20. A dust barrier system comprising:

first and second barrier panels, wherein each of the first and second barrier panels comprises:

a sheet of material comprising nylon;

first zipper teeth extending from a first side of the sheet of material;

second zipper teeth extending from a second side of the sheet of material;

a zipper slider coupled to only one of the first zipper teeth and the second zipper teeth and configured to slide along the one of the first zipper teeth and the second zipper teeth; and bottom stops at the bottoms of the first zipper teeth and the second zipper teeth, wherein the first zipper teeth of the first barrier panel mate with the second zipper teeth of the second barrier panel, wherein the first and second barrier panels are combined to form a barrier, and the bottom stops are at a bottom horizontal edge of the barrier, and wherein, in an assembled state, at least one of the first and second barrier panels is positioned at an outermost edge of the barrier, and at least one of the second zipper teeth of the first barrier panel and the first zipper teeth of the second barrier panel extend from the outermost edge of the barrier, a first pole and a second pole spaced apart and adjacent to the first pole, wherein, in an assembled state, at least the first barrier panel and the second barrier panel are positioned between the first and second poles.

* * * * *